US011885079B2

(12) United States Patent
Pawlik

(10) Patent No.: US 11,885,079 B2
(45) Date of Patent: Jan. 30, 2024

(54) METHOD OF PAVING A ROAD SURFACE AND ASPHALTING SYSTEM

(71) Applicant: JOSEPH VOEGELE AG, Ludwigshafen/Rhein (DE)

(72) Inventor: Christian Pawlik, Neustadt (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 287 days.

(21) Appl. No.: 17/232,825

(22) Filed: Apr. 16, 2021

(65) Prior Publication Data

US 2021/0324588 A1 Oct. 21, 2021

(30) Foreign Application Priority Data

Apr. 16, 2020 (EP) ..... 20169883

(51) Int. Cl.
*E01C 19/48* (2006.01)

(52) U.S. Cl.
CPC ..... *E01C 19/488* (2013.01)

(58) Field of Classification Search
CPC ..... E01C 19/488
USPC ..... 404/72, 75–95, 117, 118
See application file for complete search history.

(56) References Cited

U.S. PATENT DOCUMENTS

| | | | | |
|---|---|---|---|---|
| 8,099,218 | B2 | 1/2012 | Glee et al. | |
| 9,476,168 | B2 | 10/2016 | Oetken et al. | |
| 9,550,522 | B2 | 1/2017 | Oetken et al. | |
| 10,480,131 | B1 * | 11/2019 | McAlpine | E01C 19/004 |
| 10,662,595 | B2 | 5/2020 | Buschmann et al. | |
| 2012/0288328 | A1 * | 11/2012 | Minich | E01C 19/48 404/72 |
| 2016/0245785 | A1 | 8/2016 | Marsolek et al. | |
| 2017/0228108 | A1 * | 8/2017 | Marsolek | G07C 5/008 |
| 2019/0106846 | A1 | 4/2019 | Marsolek et al. | |
| 2021/0040710 | A1 | 2/2021 | Tanak et al. | |

FOREIGN PATENT DOCUMENTS

| | | | |
|---|---|---|---|
| CN | 101446059 | A | 6/2009 |
| CN | 108130849 | A | 6/2018 |
| DE | 10 2016 002 064 | A1 | 8/2016 |
| DE | 10 2016 001983 | A1 | 8/2016 |
| DE | 11 2015 000363 | T2 | 10/2016 |
| DE | 10 2018 124513 | A1 | 4/2019 |
| EP | 3 124 698 | B1 | 7/2017 |

(Continued)

OTHER PUBLICATIONS

European Search Report dated Oct. 7, 2020, Application No. 20169883.4-1002, Applicant Joseph Voegele AG, 11 Pages.

(Continued)

*Primary Examiner* — Raymond W Addie
(74) *Attorney, Agent, or Firm* — BROOKS KUSHMAN P.C.

(57) ABSTRACT

A method of paving a road surface by a road paver and a compactor, comprising the following method steps: paving a road surface by means of a paving screed of the road paver, defining a target rolling field by means of an electronic data processing system, determining a relative position of the compactor in relation to the target rolling field, generating a vibration of a main driving switch of the compactor, depending on the relative position to the target rolling field.

18 Claims, 3 Drawing Sheets

(56) References Cited

FOREIGN PATENT DOCUMENTS

| | | |
|---|---|---|
| JP | 2003 184131 A | 7/2003 |
| WO | 2019/181817 A1 | 9/2019 |

OTHER PUBLICATIONS

Chinese Search Report (with English Machine Translation) dated Mar. 17, 2023, Application No. 202110433436.X, 4 Pages.
Chinese Third Office Action (with English Machine Translation) dated Mar. 29, 2023, Application No. 202110433436.X, 19 Pages.
European Communication (with English Machine Translation) dated Jul. 13, 2023, Application No. 20 169 883.4-1005, Applicant Joseph Voegele AG, 12 Pages.

* cited by examiner

METHOD OF PAVING A ROAD SURFACE AND ASPHALTING SYSTEM

CROSS-REFERENCE TO RELATED APPLICATIONS

This application claims foreign priority benefits under 35 U.S.C. § 119(a)-(d) to European patent application number EP 20169883.4, filed Apr. 16, 2020, which is incorporated by reference in its entirety.

TECHNICAL FIELD

The present disclosure refers to a method of paving a road surface, an asphalt paving system comprising a road paver and a compactor, a compactor for compressing a road surface, and a main driving switch for a construction machine.

BACKGROUND

When paving road surface layers, at least one compactor in the form of a roller vehicle usually follows a road paver to compact the road surface paved by means of the paving screed of the road paver. The asphalt temperature of the newly applied road surface is an important process variable for the initial driving-in of the compactor onto the freshly paved road surface. If the asphalt is driven in too early while it is still too hot, this will lead to structural defects, such as rolling cracks. If the compactor is driven in too late, the asphalt has already cooled down considerably and less time is available for roller compaction. It is therefore important to determine exactly the right time and the right temperature for the start of roller compaction.

EP 3 124 698 B1 describes a system in which the area of the new road surface to be rolled is marked on the new road surface for the operator of the compactor, for example by a laser. From DE 11 2015 000 363 T5 a system is known in which there are display devices on the compactor which graphically show the operator information about the areas to be compacted. However, both systems have disadvantages, such as a structure that is not easy to implement or the difficulty for an operator to pay attention to display devices in addition to the paving operation. Another asphalting system in which temperature data of the paving material is taken into account is known from U.S. Pat. No. 8,099,218 B2.

SUMMARY

It is the object of the present disclosure to provide an improved system for communicating to an operator of a compactor the areas of a road surface to be traveled on.

The object can be solved by a method, an asphalting system, a compactor or a main driving switch according to the disclosure.

A method according to the disclosure for paving a road surface by a road paver and a compactor comprises the following method steps:

- paving of a road surface by means of a paving screed of the road paver,
- defining a target rolling field by means of an electronic data processing system,
- determining a relative position of the compactor in relation to the target rolling field, and

- generating a vibration of a main driving switch of the compactor, depending on the relative position to the target rolling field.

The target rolling field indicates the area of the newly paved road surface layer that is currently suitable for subsequent compaction, as it has the right temperature and should therefore be driven over by the compactor, for example a roller compactor. Driving into the uncompacted and still too hot material too early would create a kind of bow wave and thus damage the road surface. Driving into material that has already cooled down too much too late would lead to cracks, as the road surface is no longer elastic enough. The relative position of the compactor to the target rolling field expresses whether the compactor is inside or outside the target rolling field. In addition, the exact position of the compactor in relation to the target rolling field can be detected, so that the distances to the edges of the target rolling field are known, both when the compactor is outside or inside. The vibration of the main driving switch of the compactor can start when the compactor is in an area that should not be driven over. Additionally, vibration may begin when the compactor is still in a permitted area but is approaching an area not currently intended for compacting. In this case, the vibration can gradually become stronger as the compactor approaches this area.

The operator of the compactor therefore receives direct haptic feedback regarding his position. He does not have to pay attention to any other visual or acoustic signals, but can concentrate fully on operating the machine. The main driving switch is the central operating device of the compactor and is used to control forward and reverse motion. In addition, it can be formed in the form of a "joystick" and can also be used to control the lateral steering movement. Since the main driving switch is always gripped by the operator during working operation in order to control the movement of the compactor, the operator perceives the vibration signal in any case without being distracted, as would be the case when monitoring visual displays. It is also not the case that the vibration signal is no longer noticed, as is often the case with acoustic signals, which are faded out in perception.

In particular, if a vibration signal is already given when approaching the edge of the permitted area, which can additionally become gradually stronger, damage to the road surface is prevented, as the operator can stop or reverse in time.

The programming of the signaling by vibration can take into account many different parameters. For example, vibration can take place depending on the direction or side of the target rolling field at which it is left or approached. For example, there can be no vibration if the compactor leaves the target rolling field on the side facing away from the road paver, since the road surface is already compacted and solidified there anyway. On the other hand, a warning signal can be given by vibration when the compactor approaches the edge of the target rolling field facing the road paver, as there is an area of the freshly paved road surface between the road paver and the target rolling field that is still too hot and would be damaged by too early rolling. In the same way, however, a signal can also be given by vibration on each side of the target rolling field. The target rolling field is typically defined by both a front and rear limit as seen in the direction of travel of the road paver, but may also be limited by lateral edges. The lateral edges can be particularly relevant when paving two or more driving surfaces in parallel, especially when two road pavers are paving side by side, e.g., "hot to hot".

Preferably, a speed and/or a compaction power of the compactor is determined, and a vibration of the main driving switch of the compactor is generated depending on the determined speed and/or the determined compaction power. Too fast movement of the compactor on the road surface would mean heavy braking and acceleration when changing direction, which would also lead to the generation of a bow wave, i.e., pushing up and thus damaging the road surface. Excessive compaction power, i.e., excessive vibration of the rollers, would leave bumps and imprints in the road surface and result in segregation of the road surface constituents, for example upward migration of the bitumen content. Monitoring of the parameters and corresponding haptic feedback to the operator via the vibration of the main driving switch can prevent these impairments of the paving quality by allowing the operator to adjust the speed and compaction performance. It is conceivable that the vibration pattern of the main driving switch, i.e., in particular frequency and amplitude, varies depending on the type of operating parameter such as speed, position, compaction power, so that the operator recognizes which operating parameter he should correct.

In at least one variant, the relative position of the compactor is determined by detecting a GNSS signal and/or by determining a distance of the compactor to the road paver. Accordingly, the target rolling field can also be defined either by its global location coordinates or by its position in relation to the road paver. Thus, the relative position can be determined either by calculation in the global location coordinate system or by calculation in the coordinate system defined by the road paver. In the latter case, the absolute location coordinates of the compactor received by means of GNSS can also first be converted into a relative position in relation to the road paver. The determination of location coordinates by means of GNSS signal can be carried out by antennas arranged on the compactor. Likewise, location coordinate determination can be performed for the road paver. The relative position can be determined, for example, by laser measurement, radar measurement or the like, whereby the measuring device can be arranged on the road paver, on the compactor or externally. It is therefore also possible to determine the relative position of the compactor to the road paver and thus to the target rolling field using local systems and without GNSS. The "distance" can be defined as a practical distance to a point on the road paver, e.g., a connecting vector road paver—compactor. Likewise, the distance can denote, for example, a distance parallel to the direction of travel to the rear edge of the road paver.

In a practical variant, the target rolling field is defined by means of an electronic data processing system on the road paver or an external electronic data processing system and is transmitted to the compactor. A data processing system on the road paver can, for example, be located on the tractor or on the paving screed. An external data processing system may be, for example, a radio-connected job site management computer. Data processing on the road paver is advantageous in particular because further sensors, e.g., for recording a travel speed of the road paver, for measuring the asphalt temperature, etc., are usually arranged on the road paver and thus the data can be read in directly. External data processing may be easier to maintain and program. Both variants make it possible to keep the construction of the compactor simple, since then only the systems for receiving and executing the control signals for the main driving switch need to be present there. Equally, however, it is also possible to perform all or essential calculations for the target rolling field by means of a data processing system on the compactor.

In an advantageous variant, the target rolling field is determined on the basis of a temperature image of the paved road surface determined by one or a plurality of sensors and/or a temperature image generated by means of simulation calculation. Thermographic modules, pyrometers or other suitable types of temperature sensors can measure the temperature of the newly paved road surface downstream of the road paver, either over a wide area or at specific points, at one or more measuring points. The temperature sensors are conveniently arranged on the road paver or the paving screed. However, it is equally possible to measure the temperature with external devices or with sensors arranged on the compactor. The calculation can describe the temperature curve by cooling the road surface and can take into account other measured values, such as the ambient temperature and/or wind speed. Likewise, material properties of the paving material, such as bitumen content or grain size, can be taken into account. In the variants mentioned, data points are preferably generated in a two-dimensional arrangement, on the basis of which the target rolling field is defined. However, it is also possible to generate only a one-dimensional line of measurement or data points along the direction of travel, on the basis of which the sections to be traveled, defined by the distance to the paving screed or to the road paver, are defined.

In a preferred variant, the measured or calculated temperature image is compared with stored temperature data to define the target rolling field. In this way, the target rolling field can be defined on the basis of stored upper and/or lower temperature limits.

It is practical to measure the temperature of the paving material by means of a sensor before the paving material is placed by the paving screed of the road paver. The temperature values obtained in this way can serve as the basis for the above-mentioned calculation of the temperature profile over time.

In at least one variant, data representing the target rolling field is updated periodically or continuously on the compactor. For example, the target rolling field can be moved along with the road paver if this corresponds to the measured temperature development of the road surface. Likewise, the target rolling field can be enlarged or reduced if, for example, the measured values indicate this or the simulation calculation dictates this. Likewise, the already rolled area can be taken into account, for example by recording the position data of the compactor using the GNSS signal.

In a further advantageous variant, the vibration of the main driving switch comprises a plurality of vibration patterns and/or intensities which are generated depending on the relative position of the compactor to the target rolling field. For example, the vibration frequency may increase from a position near the center of the target rolling field to the edge and beyond. Thus, as the edge is approached, there may be a vibration at an even greater distance, which is perceived as individual tapping pulses, and just before, e.g., half a meter, and from the edge, there may be a high-frequency vibration. Likewise, the amplitude, i.e., the intensity of the deflection of the main driving switch, can be varied.

In one variant, optical information on the position of the compactor and/or on a remaining rolling distance and/or on a rolling distance already covered is displayed by means of a display arranged on the compactor. This provides the operator with additional exact information according to which the operator can carry out and plan the rolling operation.

In a functional variant, one or a plurality of operating states of the compactor, in particular a drive speed, are automatically controlled as a function of the relative position of the compactor to the target rolling field. For example, the speed can be automatically reduced when the compactor approaches the edge of the target rolling field from the inside. It is also conceivable to automatically stop the compactor at a certain position, e.g., at the edge of the target rolling field. It is also conceivable to automatically influence the steering so that the compactor does not leave the target rolling field at a lateral edge.

An asphalt paving system according to the disclosure comprises a road paver and a compactor, the road paver comprising a paving screed configured to pave a road surface. The road paver further comprises a temperature sensor configured to measure a temperature of the road surface being paved, and an electronic data processing system configured to determine a target rolling field and a transmitter configured to transmit the target rolling field data to the compactor. The compactor includes a receiver for receiving the data and a main driving switch that includes a vibration unit configured to be driven based on the data from the target rolling field. The paving screed may comprise extension members and/or be suitable for mounting extension members. The temperature sensor may be suitable for taking areal measurements of the temperature of the road surface, similar to a thermal imaging camera or thermography module, and/or may be suitable for taking spot measurements. The temperature measurements can be taken in front of, at or behind the paving screed.

In at least one variant, the compactor comprises an electronic data processing system configured to process the data from the target rolling field and to send control signals to the vibration unit of the main driving switch. For this purpose, the electronic data processing system can comprise a processor and a data memory.

A compactor for compressing a road surface according to the disclosure comprises an electronic data processing system, an operator station, and a main driving switch, wherein the main driving switch comprises a vibration unit configured to vibrate in response to signals received from the data processing system. The frequency and amplitude of the vibration may be variable.

A main driving switch according to the disclosure for a construction machine, in particular for a compactor, comprises an operating lever and a base housing, as well as a vibration unit which is configured to vibrate the operating lever in a targeted manner. The main driving switch can be configured in the manner of a "joystick" and enable control of the construction machine in the forward, reverse and lateral directions. It is also conceivable to provide a vibration unit such that the base housing or parts thereof can be vibrated. For example, the area of the base housing that serves as a hand rest can vibrate. Thus the location of the vibration, i.e., the operating lever or hand rest, can have an additional information content.

BRIEF DESCRIPTION OF THE DRAWINGS

In the following, the embodiments of a method of paving a road surface by a road paver and a compactor are described in more detail with reference to the figures.

Corresponding components are marked with the same reference numerals in the figures.

DETAILED DESCRIPTION

Figure 1:
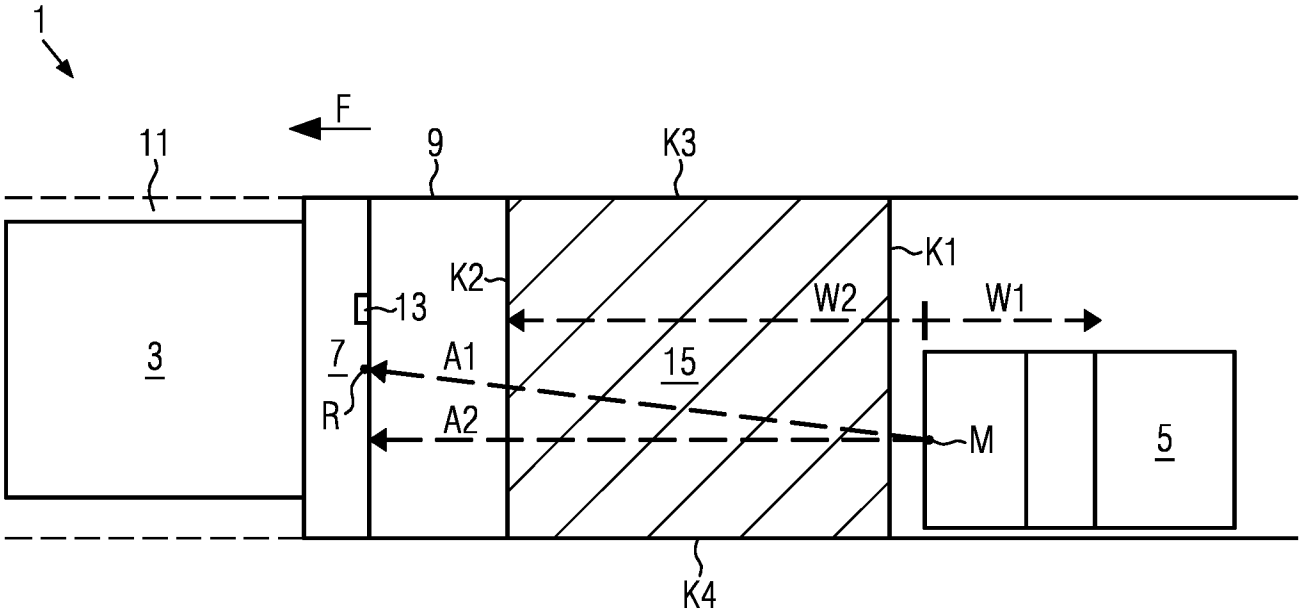
FIG. 1 shows a schematic representation of an asphalt paving system with road paver and compactor.

FIG. 1 shows a schematic representation of an asphalt paving system 1 with a road paver 3 and a compactor 5. The road paver 3 comprises a paving screed 7, which is used to pave a road surface 9 on a subgrade 11. A temperature sensor 13, which measures the temperature of the freshly paved road surface 9, is arranged on the paving screed 7 or at another location of the road paver 3, such as at a rear side of a roof of an operator station. Based on the measured temperature values, and additionally or alternatively by simulation calculation, a target rolling field 15 is calculated. By detecting a GNSS signal or by determining a distance of the compactor 5 to the road paver 3, a relative position of the compactor 5 with respect to the target rolling field 15 is determined. For example, a front center M of the compactor 5 can serve as a reference point, and the dimensions of the compactor 5 can be taken into account. For example, a direct connecting straight line A1 from a front center point M of the compactor 5 to a reference point R of the road paver 3, which is also centrally located, for example, can be defined as the distance of the compactor 5 from the road paver 3. Likewise, it would be possible to define a connecting straight line A2 parallel to the direction of travel F to the road paver 3 as a distance. The output of the vibration signals to a main driving switch of the compactor 5 can take place as a function of the position of the compactor 5 in relation to a rear edge K1 and/or a front edge K2 and/or a right edge K3 and/or a left edge K4 of the target rolling field 15. The lateral edges K3, K4 can be relevant in particular for hot-on-hot paving by two road pavers 3 next to each other. Likewise, it may already be sufficient to pay attention only to the front edge K2 as an element triggering a vibration signal in order to prevent driving into the still too hot part of the road surface 9 between the paving screed 7 and the target rolling field 15. Based on the position of the compactor 5, a rolling distance W1 already covered and a remaining rolling distance W2 can be determined.

Figure 2:
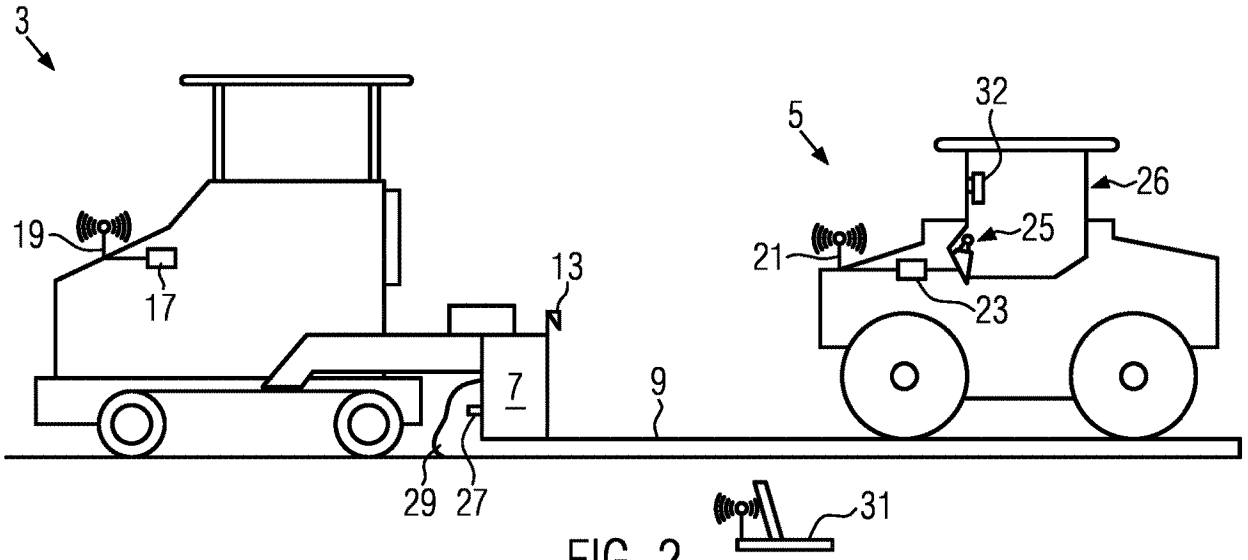
FIG. 2 shows a lateral schematic representation of an asphalting system.

FIG. 2 shows a lateral schematic representation of an asphalting system 1 comprising the road paver 3 and the compactor 5 in the form of a roller compactor. The road paver 3 is equipped with an electronic data processing system 17 and a transmitter 19 to process and exchange data with the compactor 5. For this purpose, the compactor 5 has a receiver 21 and an electronic data processing system 23. The transmitter 19 can thereby also be a receiver and the receiver 21 can thereby also be a transmitter in order to exchange data in both directions. The receiver 21 of the compactor 5 can simultaneously serve to receive a GNSS signal for position determination. However, there may also be an extra receiver for this purpose. A main driving switch 25, arranged on an operator station 26 of the compactor 5, is used for movement control and can control forward, reverse and lateral movement in the manner of a joystick, for example.

In addition to the temperature sensor 13, which measures the temperature of the paved road layer 9, in at least the illustrated embodiment, another sensor 27 is attached to the paving screed 7, which measures the temperature of the still unpaved paving material 29. The calculation of the target rolling field 15 can also be carried out by means of an external electronic data processing system 31. This data processing system 31 can be appropriately integrated into the data communication between the road paver 3 and the compactor 5 or replace a direct communication between the road paver 3 and the compactor 5. A display 32 can be provided on the compactor 5, in particular at the operator station 26, which gives information on the target rolling field 15 or the position of the compactor 5 and/or on a rolling distance W1 already covered and a remaining rolling distance W2, or other useful information.

Figure 3:
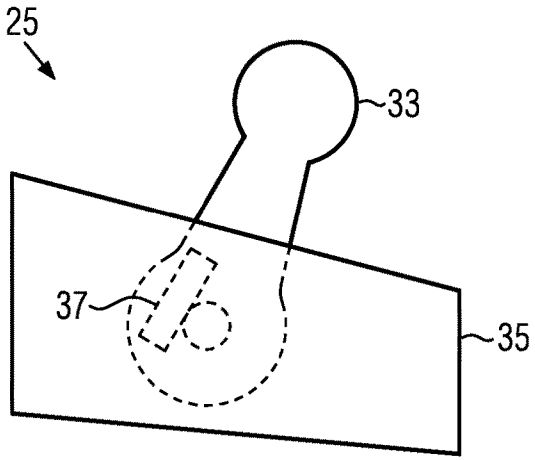
FIG. 3 shows a lateral schematic representation of a main driving switch.

FIG. 3 shows a lateral schematic representation of a main driving switch 25 comprising a control lever 33 and a base housing 35. In the partial sectional view, the vibration unit 37 can be seen, which is configured to cause the main driving switch 25 or the control lever 33 to vibrate perceptibly. For this purpose, the vibration unit 37 is controlled by the electronic data processing system 23 of the compactor 5. The vibration unit 37 may already be present as an integral component when the main driving switch 25 is manufactured, but it may also be configured as a retrofit version and be suitable for subsequent attachment.

Figure 4:
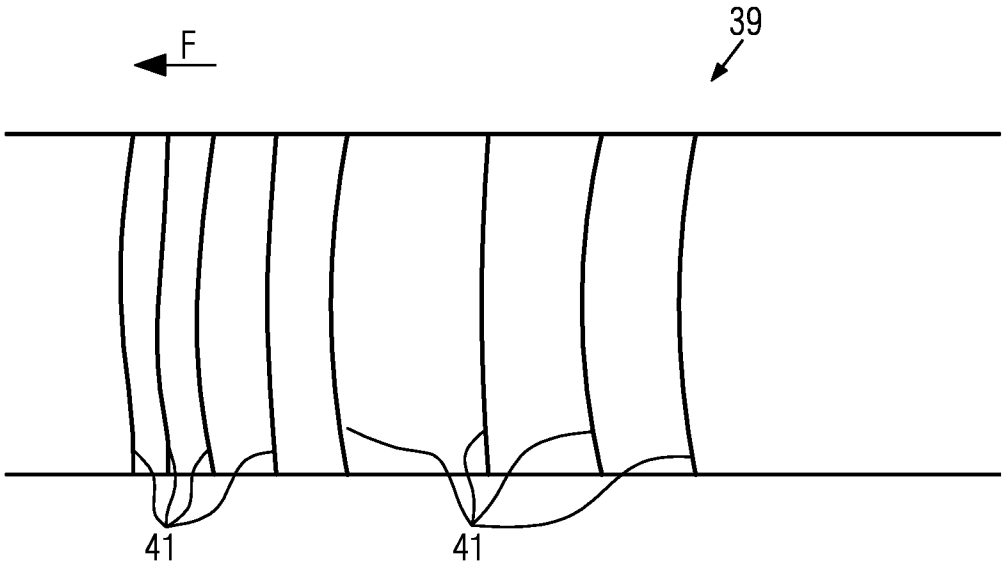
FIG. 4 shows a schematic representation of a temperature image of a road surface.

FIG. 4 shows a schematic representation of a temperature image 39 of a road surface 9. The temperature image 39 represents the temperature distribution of the road surface 9, for which purpose temperature lines 41 are shown here, which indicate lines of equal temperature, similar to a height profile. In particular, such a temperature image 39 can also mark areas of equal temperature with a uniform color in each case, as is known from the representation by means of a thermal imaging camera, although reference should be made here to the data basis and the representation is only relevant when it is displayed, for example on the display 32 of the compactor 5. The temperature image 39 can be generated by the sensor 13 of the road paver 3, e.g., an infrared camera. Equally, however, only individual points along a line parallel to the direction of travel F can be detected and recorded, with temperature differences in the transverse direction perpendicular thereto being neglected, so that the temperature of the road surface 9 is essentially characterized by temperature lines orthogonal to the direction of travel F and parallel to one another.

Based on the above embodiments of the disclosure, many variations are possible. For example, all relevant calculations and data processing steps may be performed by the data processing system 17 of the road paver 3, the data processing system 23 of the compactor 5, or the external data processing system 31. The updating of the data can be limited to the data that can be expected to change, for example, excluding the lateral edges K3 and K4 of the target rolling field 15 or updating them at a lower frequency. All sensors, in particular the temperature sensors 13, 27, can be arranged on the construction machines 3, 5, but can also be present externally, for example in the form of a mobile thermal imaging camera or a laser measuring device, which for this purpose can be set up on tripods next to the road surface 9 and equipped with GNSS receivers.

What is claimed is:

1. A method of paving a road surface by a road paver and a compactor, the method comprising:

paving a road surface by means of a paving screed of the road paver, defining a target rolling field by means of an electronic data processing system, determining a relative position of the compactor in relation to the target rolling field, and generating a vibration of a main driving switch of the compactor, depending on the relative position of the compactor to the target rolling field.

2. The method according to claim 1, wherein a speed and/or a compaction power of the compactor is determined, and a vibration of the main driving switch of the compactor is generated in dependence on the determined speed and/or the determined compaction power.

3. The method according to claim 1, wherein the determination of the relative position of the compactor is performed by detecting a GNSS signal and/or by determining a distance of the compactor to the road paver.

4. The method according to claim 1, wherein the target rolling field is defined by means of an electronic data processing system on the road paver or an external electronic data processing system and is transmitted to the compactor.

5. The method according to claim 1, wherein the temperature of the paving material is measured by means of a sensor before the paving material is paved by the paving screed of the road paver.

6. The method according to claim 1, wherein data representing the target rolling field are periodically updated on the compactor.

7. The method according to claim 1, wherein the vibration of the main driving switch comprises several vibration patterns and/or intensities which are generated depending on the relative position of the compactor to the target rolling field.

8. The method according to claim 1, wherein optical information on the position of the compactor and/or on a remaining rolling distance and/or on a rolling distance already covered is displayed by means of a display arranged on the compactor.

9. The method according to claim 1, wherein one or a plurality of operating states of the compactor are automatically controlled as a function of the relative position of the compactor to the target rolling field.

10. The method according to claim 1, wherein a drive speed of the compactor is automatically controlled as a function of the relative position of the compactor to the target rolling field.

11. The method according to claim 1, wherein the target rolling field is determined on the basis of a temperature image of the paved road surface determined by one or a plurality of sensors and/or a temperature image generated by means of simulation calculation.

12. The method according to claim 1, wherein the target rolling field is determined on the basis of a temperature image of the paved road surface determined by a temperature image generated by means of simulation calculation.

13. The method according to claim 12, wherein the measured or calculated temperature image is compared with stored temperature data to determine the target rolling field.

14. An asphalt paving system comprising a road paver and a compactor, the road paver comprising a paving screed configured to pave a road surface, the road paver further comprising a temperature sensor configured to measure a temperature of the paved road surface and an electronic data processing system configured to determine a target rolling field, and a transmitter configured to transmit the data of the target rolling field to the compactor, the compactor comprising a receiver for receiving the data and a main driving switch, wherein the main driving switch of the compactor comprises a vibration unit configured to be driven based on the data of the target rolling field.

15. The asphalt paving system according to claim 14, wherein the compactor comprises an electronic data processing system configured to process the data of the target rolling field and to send control signals to the vibration unit of the main driving switch.

16. A main driving switch for a construction machine, the main driving switch comprising an operating lever, a base housing and a vibration unit configured to vibrate the operating lever in a targeted manner.

17. The main driving switch of claim 16, wherein the construction machine comprises a compactor.

18. A compactor for compressing a road surface, the compactor comprising an electronic data processing system, an operator station, and the main driving switch of claim 15, wherein the main driving switch is configured to vibrate in response to signals received from the data processing system.

* * * * *